United States Patent [19]

Jamgochian et al.

[11] 4,211,342

[45] Jul. 8, 1980

[54] COMBINATION HOT AND COLD DRINK MACHINE

[75] Inventors: Ralph Jamgochian, Dallas; Leonard Oley, Hunlock Creek; Joseph Stachnik, Moscow; Alfred L. Tutella, Plains, all of Pa.

[73] Assignee: ARA Services, Inc., Philadelphia, Pa.

[21] Appl. No.: 881,640

[22] Filed: Feb. 22, 1978

[51] Int. Cl.[2] ..... B67D 3/00

[52] U.S. Cl. ..... 222/129.4; 222/146 R; 222/148

[58] Field of Search ..... 222/129.1, 129.3, 129.4, 222/144.5, 148, 146 R

[56] References Cited

U.S. PATENT DOCUMENTS

| | | | |
|---|---|---|---|
| 3,088,490 | 5/1963 | Rockwood et al. | 222/129.1 X |
| 3,338,153 | 8/1967 | Holstein et al. | 222/148 X |
| 3,460,713 | 8/1969 | Cornelius | 222/129.1 X |
| 3,511,413 | 5/1970 | Fuqua | 222/129.1 |
| 3,578,126 | 5/1971 | Adams | 222/146 R |
| 3,830,405 | 8/1974 | Jaeger | 222/129.3 |
| 3,976,222 | 8/1976 | Spagnolo | 222/144.5 X |
| 4,068,781 | 1/1978 | Toth | 222/129.1 X |

*Primary Examiner*—Joseph J. Rolla
*Attorney, Agent, or Firm*—Paul and Paul

[57] ABSTRACT

A vending machine for beverages is provided, allowing the selection of either hot or cold beverages from the same machine. A push-button selector can choose any of ten possible selections, three of which may be carbonated or non-carbonated cold beverages. The other selections include hot coffee, tea, Sanka, a trademark, soup and chocolate. One of the selector positions for cold beverages can be converted into a selection of hot soup by a simple turn of a switch within the machine. An electrical control system provides the necessary separation of functions between the hot and cold beverage systems of the machine. A beverage delivery outlet is further provided, permitting the dispensing of any of the hot or cold selections into a cup.

2 Claims, 6 Drawing Figures

COMBINATION HOT AND COLD DRINK MACHINE

BACKGROUND OF THE INVENTION

Automatic vending machines have been in use for a long time. However most vending machines provide either hot or cold beverages, but not both. Other machines dispense only one type of hot or one type of cold beverage. In order to satisfy the desires of consumers, it is necessary to supply vending machines for many types of beverages, including coffee, Sanka, tea, hot chocolate, soup, and cold drinks, both carbonated and non-carbonated.

In order to vend a wide variety of beverages, the procedure used in the past was to install at least two separate machines, one machine selling only cold beverages and another selling only hot beverages. While this solution provides the required variety, vending machines are unwieldy and expensive to operate. Two machines occupy twice the amount of space as one such device. The cost of operating and maintaining two machines is clearly greater than in the case of one machine. And two machines require two separate support systems, which further increases the expense. With the large increases in the prices of such machines, the use of more than one machine becomes an expensive undertaking.

It is therefore desirable to combine the vending functions of two or more machines into one. However, problems arise due to the multiplicity of control circuits required to provide adequate service to the customer. For example, it is necessary to give the customer the choice of adding cream and/or sugar to coffee, but it is also important not to allow cream and sugar to fall into a cup containing cold soda. Furthermore, each type of hot beverage must be stored and prepared separately from the other types of hot beverages, and the same applies to cold beverages. Soup must not be mixed with coffee, and cola should not appear in root beer. At the same time, the beverage selecting mechanism should be sufficiently flexible to allow a selector button to be re-designated as a hot or cold beverage selection, depending upon the vending needs of the user. The latter flexibility requirement tends to conflict with the requirement of separation of functions, and is a major problem in constructing such a combination vending machine.

SUMMARY OF THE INVENTION

This invention solves the above and other problems by providing a combination hot and cold drink machine which vends up to ten different selections. Hot beverages are prepared by heating water in a storage tank, and directing the hot water to at least one deflector valve, which sends the water into an appropriate compartment of a trough for mixing with a powdered commodity such as instant or freeze-dried coffee, tea, chocolate or soup. The machine also comprises a refrigeration unit into which water is directed, for cooling and storage. Carbonation is provided through a tank containing $CO_2$, and syrup of the appropriate flavor is also provided.

The entire machine is controlled by an electrical system, which upon insertion of coins and the pressing of a desired button, actuates a vend cycle for the appropriate period of time. The electrical system allows any of the hot or cold selections to be made at the option of the customer. The system provides for electrical separation of functions, so that the pressing of a cold beverage selector button prevents the operation of the extra cream or sugar button at the same time. The electrical system also comprises a switching means for changing the nature of one of the selector positions, so that either hot soup or a cold beverage (but, of course, not both at the same time) can be selected by the same push button according to the desires of the operator of the machine. The electrical system also controls the operation of a deflector valve system, which directs hot water into the proper compartment of the mixing trough. Thus, the desired hot beverage is mixed and delivered upon the pressing of the corresponding push-button on the selector panel.

This invention also comprises a special beverage delivery outlet, which brings together the conduits carrying beverages of the various types for delivery of any such beverage at the same, central location. This delivery outlet permits the easy dispensing of both hot and cold beverages, and also facilitates the mixing of carbonated water with syrup, when a cold carbonated drink is selected.

It is a primary object of this invention to provide a machine for vending both hot and cold beverages.

It is a further object of this invention to provide a vending machine capable of vending a large variety of beverages, including coffee, tea, chocolate, soup, and cold drinks.

It is a further object of this invention to provide a vending machine wherein the cold beverages may be obtained with or without carbonation as desired.

It is a further object of this invention to provide a beverage delivery means which allows the delivery of both hot and cold beverages to the same physical location.

It is a further object of this invention to provide a delivery means as described above, wherein said delivery means facilitates the mixing of carbonated, or non-carbonated water with syrup.

It is a further object of this invention to provide a electrical control system for a beverage vending machine.

It is a further object of this invention to provide an electrically controlled vending machine, wherein the control circuits for the hot beverages do not interfere with the control circuits for the cold beverages.

It is a further object of this invention to provide a beverage vending machine operated by push-buttons, in which the same push-button can select either a hot or a cold product, depending upon the setting of an internal switch.

It is a further object of this invention to achieve economy of cost and space by combining hot and cold beverage vending functions in one physical unit.

Other objects and advantages of this invention will be apparent to those skilled in the art from a reading of the following Brief Description of the Drawings, the Detailed Description of the Invention, the Operation of the Invention, and the appended claims.

DETAILED DESCRIPTION OF THE INVENTION

Figure 1:
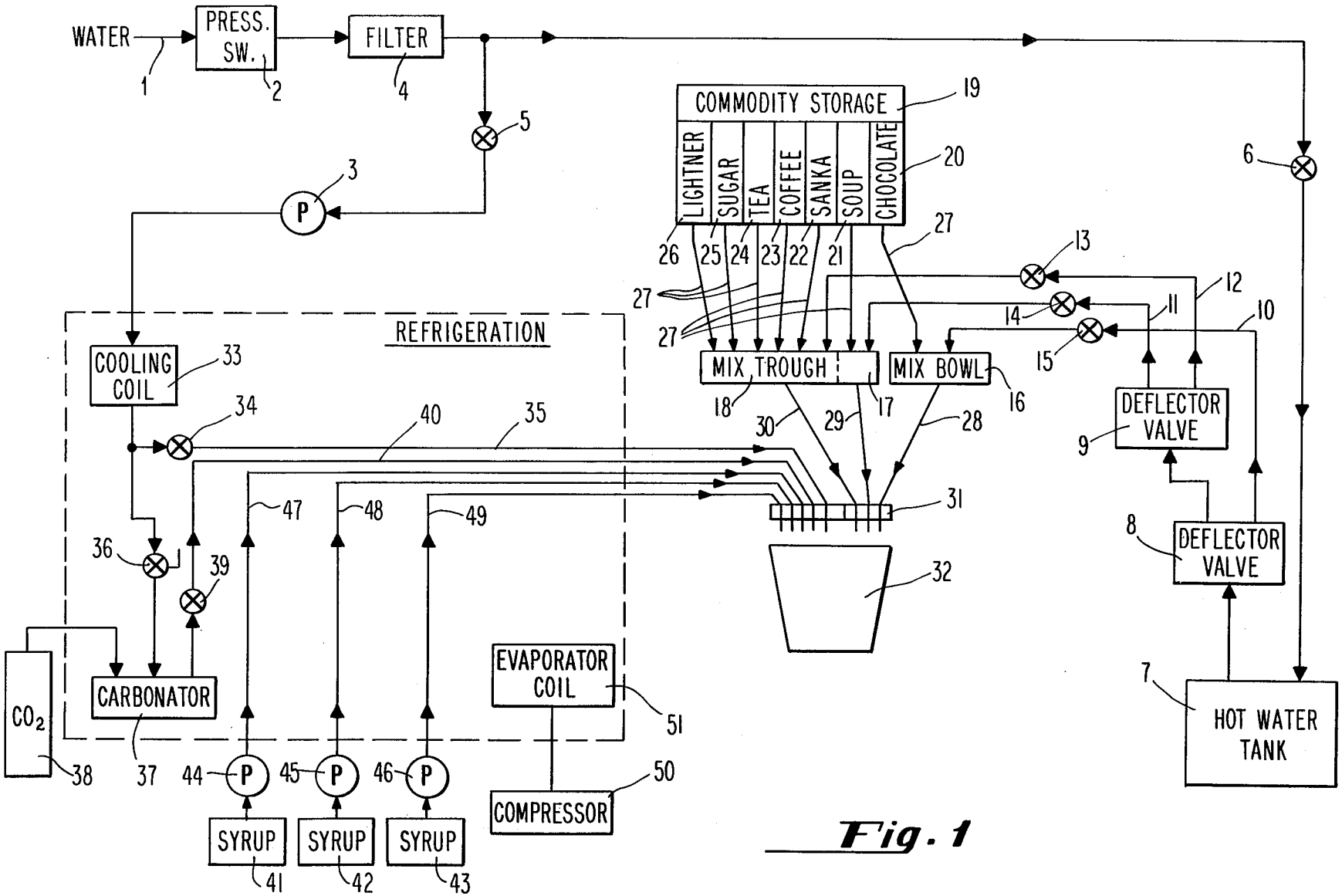
FIG. 1 is a block diagram of the beverage systems of the combination hot and cold drink machine which is the subject of the present invention.

The operation of the combination hot and cold drink machine which is the subject of the present invention is best understood with reference to the block diagram of the beverage system shown in FIG. 1. A source of water flows through water line 1 into water pressure switch 2. Water line 1 supplies water for both hot and cold beverages. Water pressure switch 2 is used to interrupt power to the vending circuits when the pressure in water line 1 drops below 8 pounds per square inch. Water proceeds through water filter 4 which removes impurities and foreign or solid particles in the water which could be harmful to the water system components, or which could affect the taste or quality of the finished drink. A special water stabilizer (not shown) may also be included, to reduce the formation of lime scale when the water is heated.

As indicated by the arrow, the water then enters valves 5 and 6, connected respectively to the cold and hot beverage systems of the machine. The water passing through valve 6 proceeds to hot water tank 7. Hot water tank 7 is provided with conventional heating means, not shown in FIG. 1, as well as a hot water pump, a float assembly, a control thermostat, and a safety thermostat, of types which are known in the art. Hot water tank 7 is equipped with a 1350 watt immersion heater which maintains the water tank temperature at approximately 180°. The water in hot water tank 7 is used for all hot drink selections, and the hot water pump incorporated in hot water tank 7 forces water up out of the tank into deflector valves 8 and 9. A float assembly in the hot water tank 7 determines whether the machine is off or on, according to the water level within tank 7, thereby controlling the water entering the tank and the heating of the water. A safety thermostat in hot water tank 7 breaks power to the heating element when it senses a temperature above a predetermined value.

Deflector valves 8 and 9 are operated by solenoids, controlled by the electrical system to be described below. Each deflector valve has one input and two outputs. Fluid is channeled through either output, according to the presence or absence of current flowing through the solenoid. Thus, the combination of the two deflector valves 8 and 9 directs the hot water coming from hot water tank 7 into any of three water lines 10, 11, and 12. Water in these water lines flows through gate valves 13, 14, and 15, which regulate the amount of water being dispensed. Water flowing through gate valve 15 then enters mixing bowl 16, to be mixed with chocolate to form hot cocoa. Water flowing through gate valve 14 flows into compartment 17 of a mixing trough comprising separate compartments 17 and 18 to be mixed into soup. Water flowing from gate valve 13 flows to compartment 18 of the mixing trough to be mixed with tea, coffee, or Sanka, with appropriate lightener and/or sugar. The dry commodities are stored in storage area 19 which contains separate commodity canisters 20–26, containing, in dry form, chocolate, soup, Sanka, coffee, tea, sugar, and lightener. Commodities proceed in the direction shown by the arrows 27 into the mixing trough or mixing bowl, wherever appropriate, to be mixed with hot water from the hot water tank 7. The finished beverages flow through delivery lines 28, 29, or 30, into beverage delivery outlet 31, and thence into cup 32.

Water which passes through inlet valve 5 supplies water for cold beverages. Inlet valve 5 supplies water to be dispensed in non-carbonated form, or to be pumped into carbonator 37. The valve 5 operates only when the carbonator is calling for water or when a non-carbonated selection is made. This water passes through water pump 3, and through cooling coil 33. The water pump delivers water at 130 p.s.i. either for carbonation or for direct dispensing. Cooling coil 33 is made of stainless steel and is immersed in the water bath, so that water entering the cold beverage area is pre-chilled in the cooling coil before it is carbonated or dispensed in a non-carbonated drink. Also, syrup may be routed through the stainless steel dip tubes, not shown in FIG. 1, in the water bath, to be pre-chilled before dispensing.

Water flowing out of cooling coil 33 may enter the two-way skinner valve 34 used for dispensing non-carbonated water. Valve 34 is electrically activated by means of a solenoid. Such water flows through line 35 into beverage delivery outlet 31 and cup 32. Water which is to be carbonated passes through the three-way skinner valve 36 and enters carbonator 37. Water and $CO_2$ inlets on the carbonator 37, permit free flow into the carbonator but prevent reverse flow from the carbonator into its sources of water and $CO_2$. Valve 36 is electrically operated by a solenoid, and, when energized, allows water to flow from cooling coil 33 through a check valve (not shown), and into carbonator 37. If the check valve should fail, $CO_2$ from carbonator 37 can escape into the air through the exhaust tube of valve 36. Thus, in an emergency, there would be no danger of $CO_2$ entering the main water supply and contaminating the water lines. A tank containing $CO_2$, indicated as 38, feeds carbon dioxide into the carbonator. The carbonator 37 serves the dual purpose of mixing water and $CO_2$ gas to obtain carbonated water, and of storing a constant reserve of carbonated water for immediate use. The carbonator 37 is immersed in a water bath to insure delivery of cold carbonated water even during high-volume dispensing. A pressure relief valve, set to relieve pressure in excess of 155 p.s.i., is incorporated into carbonator 37 for safety reasons. Carbonated water is dispensed through a dip tube in the carbonator and into two-way skinner valve 39 and proceeds along line 40, where it is delivered at beverage delivery outlet 31, and falls into cup 32. Lines 35 and 40 may also be combined by a plastic Y-connector, in which case there would be only four cold beverage lines, instead of the five shown in FIG. 1. Valve 39 is also controlled by a solenoid, and must be energized to allow carbonated water to flow from the carbonator. Syrup for the various cold drinks is stored in tanks 41, 42, and 43. Syrup is dispensed through syrup pumps 44, 45, and 46, and through lines 47, 48, and 49, through beverage delivery outlet 31, and into cup 32. Syrup pumps 44, 45, and 46 contain check valves that prevent reverse flow of syrup. Refrigeration of the entire cold beverage system is accomplished by a compressor unit 50 and evaporator coil 51.

Figure 2:
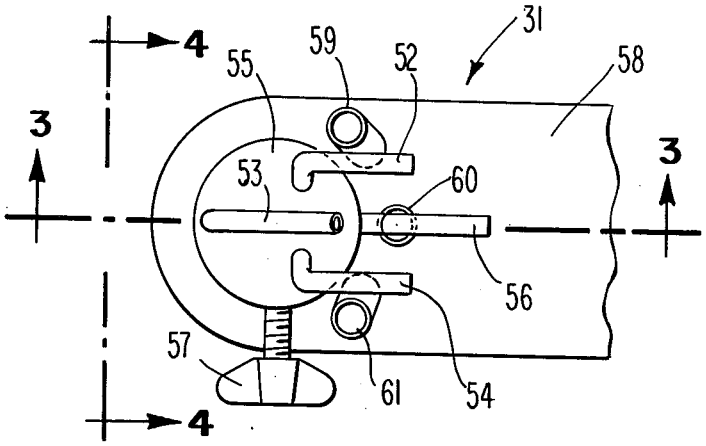
FIG. 2 is a top fragmentary view of the beverage delivery outlet which is used in the present invention.
Figure 4:
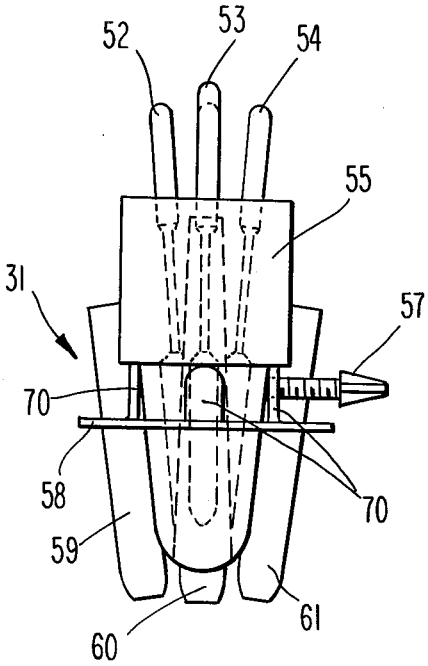
FIG. 4 is an end view of the beverage delivery outlet, taken along the line 4—4 of FIG. 2.
Figure 3:
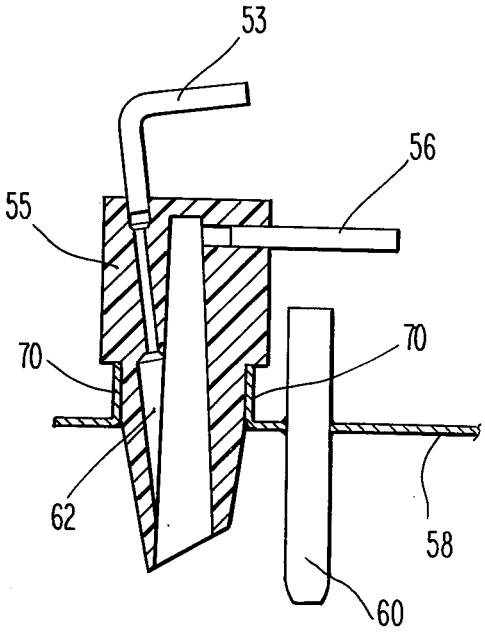
FIG. 3 is a local cross-sectional view of the beverage delivery outlet, taken along the line 3—3 of FIG. 2.

Beverage delivery outlet 31 is shown in more detail in FIGS. 2–4. In FIG. 2, there is shown a top view, in fragmentary form, of beverage delivery outlet 31. Beverage delivery outlet 31 is a special manifold which accepts all hot and cold drink selections, having been prepared at various places in the machine, for delivery at one centralized location. Cold beverage conduits 52, 53, 54, and 56 accept cold fluids from the cold beverage portion of the machine, and direct such fluids through a solid plastic material 55 in which the conduits are embedded. The assembly consisting of the plastic material 55 and the conduits 52, 53, 54, and 56 is attached to metal plate 58 by means of screw 57. Mounted through metal plate 58 are hot beverage conduits 59, 60, and 61. In order to use the beverage delivery of FIGS. 2–4 with the machine shown in FIG. 1, lines 35 and 40 would be combined through a Y-connector (not shown), and either carbonated or non-carbonated water would enter conduit 56 of beverage delivery outlet 31.

FIG. 3 shows a local cross-sectional view of beverage delivery outlet 31, taken along the line 3—3 of FIG. 2. The view of FIG. 3 shows more clearly the operation of beverage delivery outlet 31 in its drink-mixing function. Cold water, carbonated or non-carbonated enters outlet 31 through conduit 56. Syrup of an appropriate flavor enters outlet 31 through conduit 53. Both conduits are embedded in solid plastic material 55, but the conduits come together at the location indicated by 62, where syrup and water can mix before entering the drinking cup. Also visible in FIG. 3 is a hot beverage conduit 60, which is also seen in FIG. 2, passing through metal plate 58. Plate 58 has tabs 70 extending from it at right angles.

The structure of beverage delivery outlet 31 is further illustrated in the end view of FIG. 4, taken along the line 4—4 of FIG. 2. Cold beverage conduits 52, 53, and 54 are seen embedded in plastic material 55 which is attached to outlet 31 by screw 57 passing through tab 70 attached to plate 58. The other tabs 70, which do not have holes for receiving screws, are also shown. Hot beverage conduits 59, 60, and 61 are shown mounted through metal plate 58, as described above.

Figure 5A:
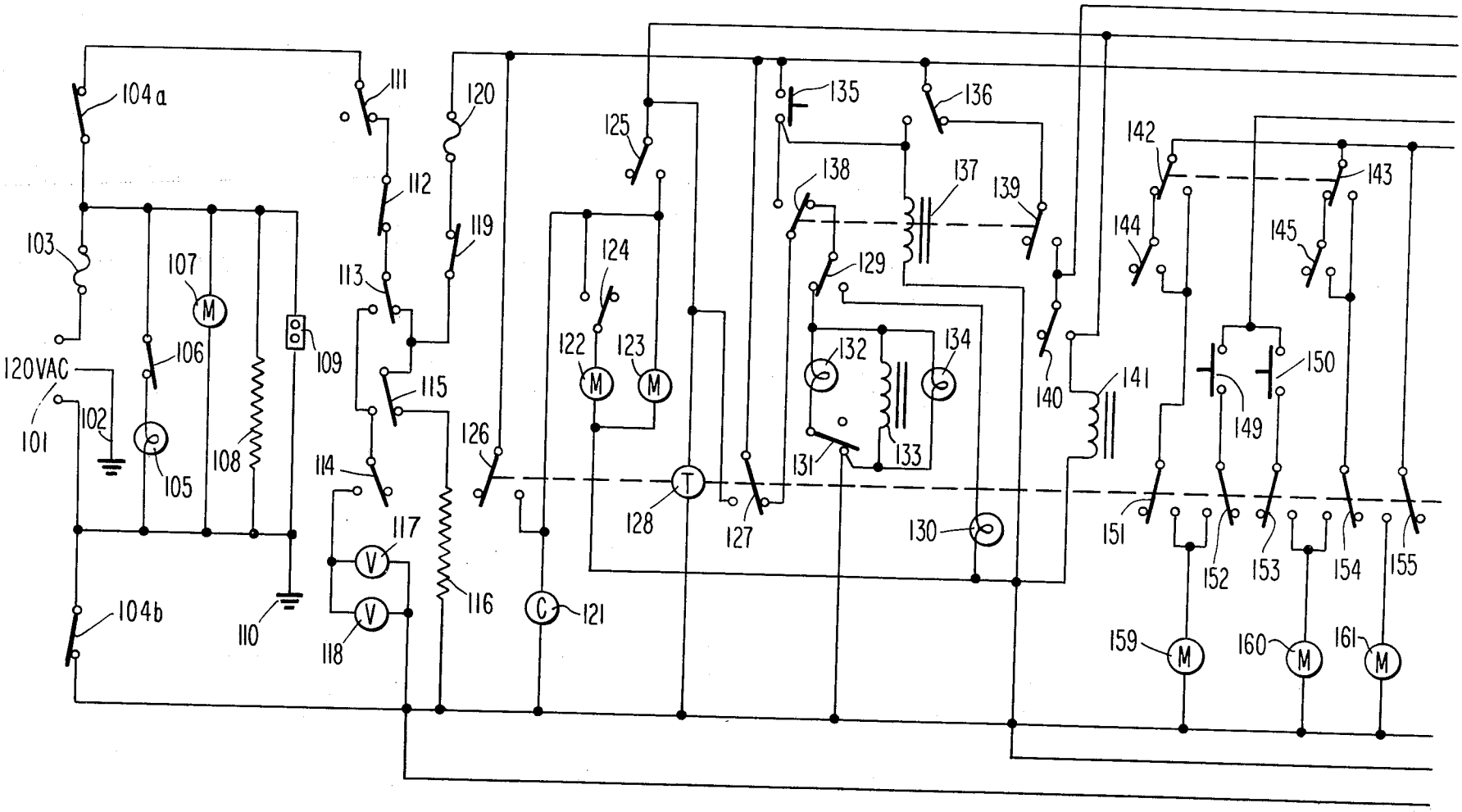
FIGS. 5*a* and 5*b* together comprise a circuit diagram of the electrical control system for the combination hot and cold drink machine disclosed in this invention.
Figure 5B:
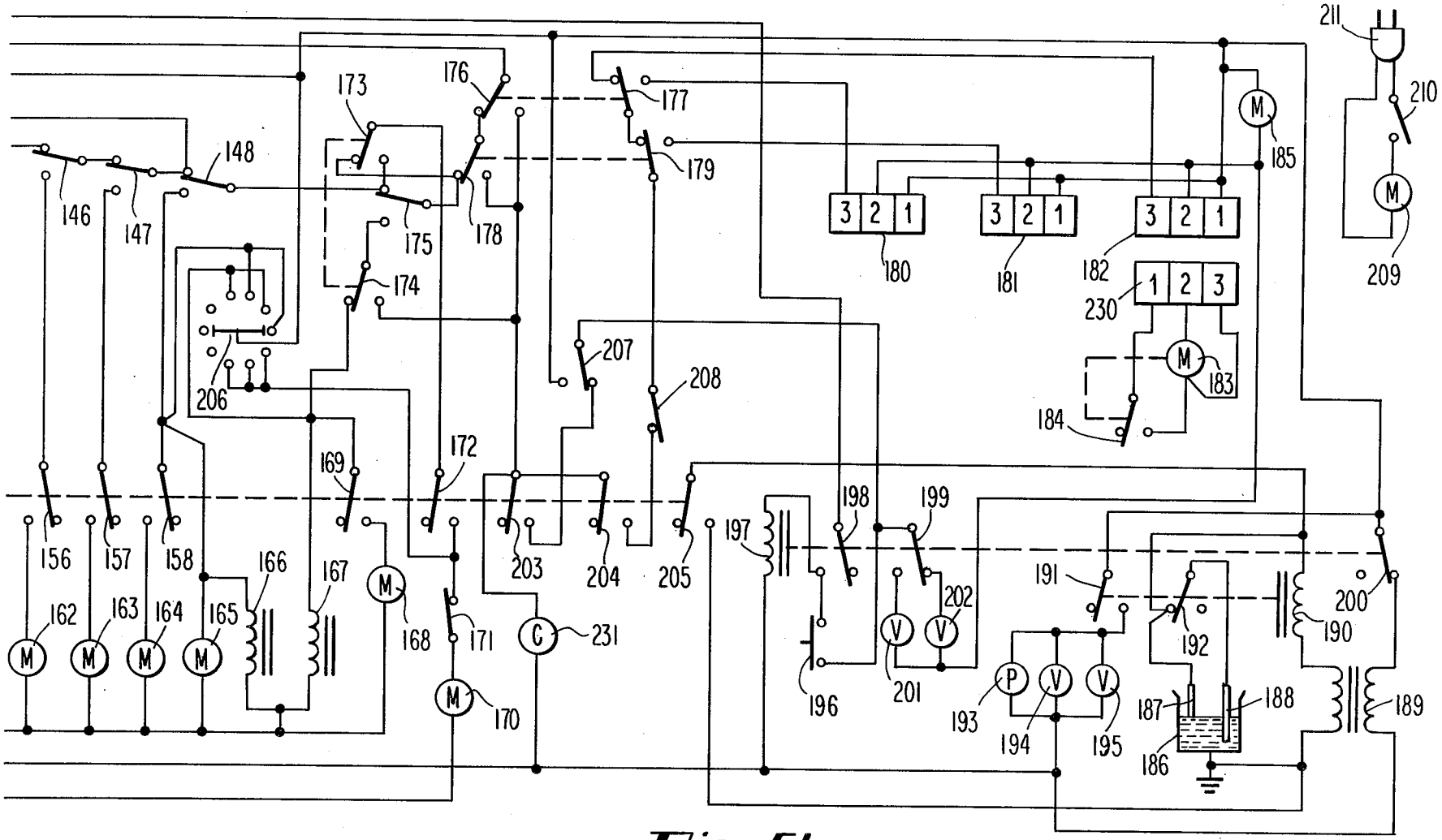

The circuit diagram of the electrical control system for the combination hot and cold drink machine is shown in FIG. 5*a* and 5*b*. The system operates from conventional 120 volt AC lines, the power being connected at the point indicated by the numeral 101 in FIG. 5*a*. The power plug further has a ground connection 102. A 20 ampere fuse 103 is provided for protection against overloads. The main line switch (not shown) actuates switches 104*a* and 104*b* to provide power to the entire machine. Service lamp 105 is provided, along with lamp switch 106. Exhaust motor 107 and bar heater 108 are also connected across the source of power. Bar heater 108 is located near the commodity canisters illustrated in FIG. 1, and helps keep the commodities warm and dry. Additional power receptacle 109 and ground connection 110 are also provided.

The circuit shown in FIG. 5*a* and FIG. 5*b* shows the machine in the stand-by position with the hot water tank full, the water tank heater on, the cup dispenser switches actuated, and the carbonator full. Internal switches 173 and 174 which allow one of the selector buttons to select either hot soup or a cold drink are shown in the "soup" position. The operation of these switches will be described below.

The control circuits for the hot water system will first be explained. Current flows through waste pail switch 111 and safety switch 112 when the main switch is ON and these switches are closed, provided switches 113, 114, and 115 are properly positioned. The waste pail (not shown) is located below the cup, and serves to take up any excess liquid. Waste pail switch 111 is a microswitch which interrupts power to the apparatus if the waste pail should overflow. Low level float switch 113 and high level float switch 114 are set according to the water level in the hot water tank. Switch 115 is set by a thermostat, and activates tank heater 116 when the temperature of the water in the tank reaches too low a level. The float switches 113 and 114 also control water inlet valves 117 and 118 to allow water into the hot water tank when necessary. Additional protection is provided by water pressure switch 119 and 10-ampere fuse 120.

The circuits which control the mechanics of the vending operation are described next. Counter 121 counts the total number of drinks that have been sold. The means for dispensing a cup comprises a turret motor 122, a cup-dropping motor 123, a turret motor switch 124, and a cup drop motor hold switch 125. Cup dropping motor 123 dispenses cups mechanically by means of a conventional gear arrangement. Turret motor 122 rotates a turret containing stacks of cups when all cups in a stack have been used. Turret motor switch 124 is a spring-biased switch which mechanically detects the absence of cups. When a stack is empty, switch 124 closes causing motor 122 to rotate the turret until a new stack moves into position. Switch 125 operates by a cam on cup dropping motor 123, and, together with cam switch 127, maintains power to motor 123 after the initial impulse of current to motor 123 has been supplied by switch 126, to be described more fully below. Timer 128 is a motor which turns a cylinder containing a plurality of cam switches. All cam switches open and close automatically at predetermined times during a vend cycle, as will be described shortly. The structure of the cylinder cams (not shown) governs the length of time each switch is closed. However, as will be seen, some of the various cam switches, although closed, have no effect unless the proper pushbutton is also pressed. Switch 129 is activated when no more cups remain in the machine, and activation of switch 129 causes sold-out lamp 130 to light. Coin tube switch 131 is a mechanical switch which causes exact change lamp 132 to light when the machine does not have change. The vend lamp 134 is also used to monitor the operation of the machine. Switch 135 causes the machine to vend without the need to deposit coins, thus facilitating maintenance of the machine. Coin switch 136 is actuated when coins are deposited into a conventional electronic or mechanical coin mechanism. Either of switches 135 or 136 will enable current to flow through vend relay 137 which makes vending possible by actuating switches 138 and 139 as will be more fully described below. Coin return electromagnet 133, when energized, allows coins to actuate coin switch 136 in the usual manner. But when an abnormal condition occurs, as when no more cups remain, electromagnet 133 is de-energized, thereby blocking the path for coins, and causing any coin inserted to fall into a coin return slot.

While the machine described herein has a plurality of pushbuttons for selecting a beverage, each pushbutton actuates one lock bar switch 140 which prevents further selections from being made during the vend cycle. Lock bar switch 140 is connected to lock bar solenoid 141 for this purpose. Lock bar switch 140 is actuated during all vending operations. Solenoid 141 pulls a mechanical linkage which keeps the lock bar switch 140 closed during a vend cycle, and also locks the particular pushbutton pressed in its position. Selections of beverages are made through pushbuttons which comprise switches 142 and 143, for selecting coffee light with sugar; switch 144 for selecting coffee with sugar only; switch 145 for selecting coffee light without sugar; switch 146 for selecting tea; switch 147 for selecting Sanka; and switch 148 for selecting hot chocolate. Other pushbutton switches will be discussed presently. Note the additional switches 149 and 150 which provide extra sugar and extra lightener respectively. The motor means for dispensing the various dry commodities are actuated by appropriate cams on the vend timer. These cams comprise switches 151–158 which are seen in FIG. 5*a* and FIG. 5*b*. Switches 151 and 152 actuate sugar motor 159 at different times during the vend cycle. The extra sugar button actuates switches 149, which energizes motor 159, allowing an additional amount of sugar to fall into the mixing trough. Switch 151 actuates motor 159 to provide the regular amount of sugar. Switches 153 and 154 operated lightener motor 160, in similar fashion to that of motor 159. Switch 150 is actuated by the extra-lightener pushbutton. Switch 155 operates coffee motor 161; switch 156 operates tea motor 162; switch 157 operates Sanka motor 163; and switch 158 operates chocolate motor 164. Motor 165 functions as a chocolate whipper; it is to be recalled that chocolate is prepared in a separate compartment from the general mixing trough. Also soup motor 168 is actuated by cam switch 169.

Water flows through the hot beverage system by virtue of a hot drink pump operated by motor 170 shown in FIG. 5*b*. Switch 171 is manually operated, and is normally closed, except when opened for maintenance of the machine. Solenoids 166 and 167 control the flow of hot water through the deflector valves, shown in the block diagram of FIG. 1. The particular settings of the deflector valves depend upon the particular pushbutton selections that have been made. Also note cam switch 172 which operates hot water pump motor 170, and which controls the length of time the hot water pump will run during a hot drink vend cycle.

One of the unique and novel features of this invention is the capability of selecting either a hot or cold beverage with the same physical pushbutton, depending upon the setting of an internally located switch. This switch, which is double-pole-double-throw, is illustrated by reference numerals 173 and 174. The switches are shown in the position for selecting soup, and in this position, depressing of the pushbutton results in actuation of the soup delivery mechanism. If the positions of switches 173 and 174 are reversed, the same pushbutton would cause a cold beverage to be selected instead of hot soup. Switch 175 is the pushbutton switch which can select either the soup or the cold beverage, according to the setting of switches 173 and 174.

The remaining cold beverage selections are accomplished by switches 176 and 177, which are mechanically attached to each other, and switches 178 and 179 which are also activated by the same pushbutton. Connecting means 180, 181, 182, and 230, connect the soda selection mechanism to the syrup pump motor and switch, the syrup pump being illustrated as 183 and the switch indicated by 184. Only one syrup pump motor and switch is shown, for clarity of illustration, but it is understood that an assembly of the same type would fit into connecting means 180 and 181. Common to all cold beverage selections is agitator motor 185.

More controls for the cold beverage portion of the machine described herein are shown in FIG. 5*b*. The carbonator 186, illustrated schematically in the figure, contains two electrodes, a short electrode 187 and a long electrode 188. Electrodes 187 and 188 automatically control the water pump circuit to maintain the proper water level in carbonator 186. This job is accomplished by means of liquid level transformer 189, operating relay 190. Relay 190 actuates switches 191 and 192 which in turn control pump motor 193 and water inlet valve 194, as well as $CO_2$ exhaust valve 195.

If no carbonation is desired in a cold beverage, the non-carbonation push button switch 196 is depressed, and relay 197 is activated, affecting switches 198 and 199, and 200. Thus, the valve 201 which regulates non-carbonated water, and the valve 202 controlling carbonated water are properly set. Cam switches 203, 204, and 205 are activated by the vend timer as described above, and control the dispensing of soda water, the dispensing of syrup, and the soda pump in general respectively. Switch 205 operates relay 190. When energized, relay 190 breaks the circuit to the cold beverage pumping system, so that water pump 3 (see FIG. 1) is not operating during a hot or carbonated cold drink vend cycle. Pump 3 does operate, however, during the vend cycle for non-carbonated cold drinks. Switch 204 sets up the initial start circuit for the syrup pump, such as 183. Switch 203 controls the length of time that carbonated water will be dispensed during a vend cycle. A cold drink counter 231 is also provided to count the number of cold drinks sold.

In addition to the features described above, there are several more internal switches which aid in the maintenance of the combination hot and cold drink machine. Switch 206 is a rotary switch which directs water into an appropriate compartment of the hot beverage mixing areas, in order to wash them when desired. When switch 207 is activated, soda water runs through the machine continuously, as another aid in adjustment and maintenance. Similarly, switch 208 turns the syrup pump on or off.

The cold beverage section of the machine described herein is refrigerated by compressor 209, controlled by switch 210, and receiving its power through plug 211, which plugs into the convenience receptacle on the main control box, not shown.

One of the new and useful features of the present invention is the separation of the control circuits for hot and cold beverages. In particular, it is important that the machine not accidentally deliver sugar or lightener into cold beverages or hot soup. This separation of functions is accomplished by the control circuit shown in FIG. 5*a* and FIG. 5*b*. It is seen that switches 149 and 150, which control the extra sugar and extra lightener functions, have no effect when cold beverage switches 176 or 178 are actuated. Similarly, the selection of soup, by the actuation of switch 175 also causes the extra sugar and extra lightener circuits to be isolated and inoperative. If switches 173 and 174 are moved to the position which causes the selection, by switch 175, of a cold beverage instead of soup, the same isolation effect occurs, and no sugar or lightener appears in a cold drink. Also, it is seen that the actuation of switch 148 similarly isolates the extra sugar and extra lightener functions from the preparation of hot chocolate.

OPERATION OF THE INVENTION

The circuit diagram of the electrical control system of the combination hot and cold beverage machine, shown in FIGS. 5*a* and 5*b*, is illustrated with the machine in the stand-by position. When the appropriate amount of money is deposited into the machine, coin switch 136 closes momentarily and energizes vend relay 137. Relay 137 causes switches 138 and 139 to assume the opposite position from that shown in FIG. 5*a*. After coin switch 136 has opened again, relay 137 retains its power by virtue of switches 138 and 127.

After coins have been deposited, a beverage is selected by depressing the proper push button. Each pushbutton actuates lock bar switch 140. Most of the pushbuttons also actuate other switches besides switch 140. When lock bar switch 140 is closed, current flows through lock bar solenoid 141, through the path created by switches 140, 139, and 136 (note that switch 136 is open again, having closed only momentarily). Lock bar solenoid 141 is connected to pull a mechanical linkage, not shown, which holds lock bar switch 140 in the closed position, and also holds the pushbutton selected in the depressed position.

It is seen that vend timer motor 128 is connected in parallel with lock bar solenoid 141, so that when solenoid 141 is energized, motor 128 begins to operate. Vend timer motor 128 turns a cylinder means which actuates all the cam switches. The cam switches, indicated by reference numerals 151–158, 159, 172, 203, 204, and 205, all open and close at least once during a twelve-second vend cycle, but the opening and closing occurs at different points in the vend cycle for each switch. The timing of the opening and closing of each switch is determined by the physical construction of the cylinder (not shown) which is turned by motor 128.

Vend timer motor 128 causes cam switch 127 to change position at the beginning of the vend cycle. When switch 127 moves, the vend relay 137 is de-energized. Lock bar solenoid 141 no longer obtains power through switch 139, but it retains its energized state by virtue of the alternative path created through switch 127 in its actuated position. Switch 127 remains in the actuated position for the duration of a vend cycle.

Cam switch 126 then closes momentarily, supplying a pulse of power to cup drop motor 123. Power is also supplied to turret motor 122, in the event that turret motor switch 124 has been actuated mechanically by the absence of a stack of cups. When a stack of cups becomes empty, the turret motor operates to rotate the turret, not shown, so that a fresh stack of cups is positioned for easy dispensing. Cup drop motor 123 actuates its cam switch 125, which switch supplies power to motor 123 (after cam switch 126 has opened again). Cup drop motor switch 125 returns to the normal state due to the cam action of motor 123, after a cup has been dropped mechanically.

As stated above, the cam switches which are actuated by vend timer motor 128 all open and close at various times during the vend cycle. But not all these switches have operative effect. Only if the proper pushbutton has been pressed will the desired circuit be completed. For example, suppose that the black coffee pushbutton has been depressed. The black coffee pushbutton is the only pushbutton which actuates *only* lock bar switch 140. It is seen that coffee motor 161 receives current through the path defined by cam switch 155, and switches 146, 147, 148, 175, 178, and 176. It is seen that the coffee motor 161 is thus connected in parallel with the lock bar solenoid 141. Thus current flows through motor 161, and this motor causes a measured amount of powdered coffee to drop from commodity canister 23 (shown in FIG. 1) into the mixing trough below. At the same time, cam switch 172 enables current to flow through hot drink pump motor 170, through the path defined by switches 173, 178, and 176. Because soup selection switch 175 and chocolate selector switch 148 has *not* been depressed, no current will flow through solenoids 166 or 167, which control the deflector valve, not shown. Thus, hot water is directed into the normal compartment of the mixing trough, where it mixes with the coffee and is directed into the cup below.

Other hot beverage selections are made in a similar manner. For example, if tea is selected, the tea pushbutton actuates switch 146 in addition to the lock bar switch 140. Switch 146 causes power to be directed to tea motor 162, and, at the same time, prevents current from flowing through coffee motor 161. Thus, when cam switch 156 closes during the vend cycle, it will be the tea motor, and not the coffee motor, which supplies the dry commodity. In the case of such beverages as hot chocolate, the selector button will also energize the chocolate deflector solenoid 166, causing hot water to flow into the chocolate mixing bowl, not shown, which is separate from the other compartments.

The preparation of cold drinks is similar to that of hot drinks. Cold drinks require the mixing of syrup with carbonated or non-carbonated water. If a cold drink selection is made, as could be done by pressing the pushbutton which actuates switches 176 and 177 together, cam switch 204 provides a current impulse to a syrup motor such as 183 (recall that only one syrup motor is illustrated, for purposes of clarity, and that all syrup motor assemblies would appear alike on the circuit diagram). Syrup motor 183 actuates its own switch 184, by a cam action, which causes the motor to pump syrup for a period dictated by the cam action of switch 184. At the same time, valve 202 or valve 201 (for carbonated or non-carbonated beverages, respectively) opens by means of a solenoid, to allow water to flow toward the beverage delivery outlet. The absence of carbonation is determined by the state of non-carbonation relay 197. Cam switch 205 sets up a circuit to the liquid level relay 190, to energize the relay if it is not already energized through the electrode circuit defined by electrodes 187 and 188. The liquid level relay 190, when energized, breaks the circuit to pump 193. Pump 193 does not operate during a hot or cold drink vend cycle, except when a non-carbonated drink selection is made. This is because excessive pressure in the cold water line, due to action of the pump, would prevent the valves from opening normally.

Throughout the vend cycle, the coin return electromagnet coil 133 is de-energized. The coin mechanism will refuse to accept more coins until the vending is complete.

At the end of the vend cycle, cam switch 127 moves back to its original position. Therefore, lock bar solenoid 141 loses power, and releases the linkage, which returns any depressed pushbutton to its original position, and which allows the machine to be used again.

The machine described herein automatically maintains the proper water levels in both the hot water tank and the cold water system. As described above, float switches 113 and 114 control the level in the hot water tank, and the electrode circuit comprising electrodes 187 and 188 performs a similar function for the cold water system.

It is apparent that the objects of this invention have been amply met by the above disclosure. Many additional improvements and variations are intended to be included within the scope of this disclosure, and the claims appended hereto should not be interpreted as limiting the invention to the specific embodiment described herein.

What is claimed is:

1. In a combination hot and cold beverage vending machine having a fixed total number of selectable beverages and at least one selector button, switching means for varying the numbers of hot beverage selections and cold beverage selections offered for sale by said machine, said switching means comprising at least one double pole double throw switch, said switch being operable from within the housing of said machine, said switch directing the signal from said selector button to motor means for vending the hot or cold beverage chosen by said selector button.

2. In a combination hot and cold beverage vending machine having at least one cold beverage selector button and at least one hot beverage selector button and an extra cream button and an extra sugar button, switching means for nullifying the effect of said cream and sugar buttons when said cold beverage selector button is actuated.

* * * * *

UNITED STATES PATENT OFFICE

CERTIFICATE OF CORRECTION

Patent No. 4,211,342 Dated July 8, 1980

Inventor(s) Ralph Jamgochian et al

It is certified that error appears in the above-identified patent and that said Letters Patent are hereby corrected as shown below:

Column 7, Line 8, before "switches" insert --pushbutton--.

Signed and Sealed this

Ninth Day of December 1980

[SEAL]

Attest:

SIDNEY A. DIAMOND

Attesting Officer

Commissioner of Patents and Trademarks